US010253642B2

(12) United States Patent
Hough et al.

(10) Patent No.: US 10,253,642 B2
(45) Date of Patent: Apr. 9, 2019

(54) GAS TURBINE ENGINE WITH DISK HAVING PERIPHERY WITH PROTRUSIONS

(71) Applicant: United Technologies Corporation, Hartford, CT (US)

(72) Inventors: Matthew Andrew Hough, West Hartford, CT (US); Jeffrey S. Beattie, South Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 385 days.

(21) Appl. No.: 15/021,944

(22) PCT Filed: Aug. 21, 2014

(86) PCT No.: PCT/US2014/051979

§ 371 (c)(1),
(2) Date: Mar. 15, 2016

(87) PCT Pub. No.: WO2015/038305

PCT Pub. Date: Mar. 19, 2015

(65) Prior Publication Data

US 2016/0222808 A1 Aug. 4, 2016

Related U.S. Application Data

(60) Provisional application No. 61/878,096, filed on Sep. 16, 2013.

(51) Int. Cl.
*F01D 5/14* (2006.01)
*F01D 11/00* (2006.01)
(Continued)

(52) U.S. Cl.
CPC ..... *F01D 11/006* (2013.01); *F01D 5/081* (2013.01); *F01D 5/3015* (2013.01);
(Continued)

(58) Field of Classification Search
None
See application file for complete search history.

(56) References Cited

U.S. PATENT DOCUMENTS 4,029,436 A * 6/1977 Shoup, Jr. ..... F01D 5/323 416/193 A
4,474,532 A 10/1984 Pazder
(Continued)

FOREIGN PATENT DOCUMENTS

EP 0437977 7/1991

OTHER PUBLICATIONS

International Preliminary Report on Patentability for PCT/US2014/051979 dated Mar. 22, 2016.
(Continued)

*Primary Examiner* — Woody Lee, Jr.
*Assistant Examiner* — Jason Fountain
(74) *Attorney, Agent, or Firm* — Carlson, Gaskey & Olds, P.C.

(57) ABSTRACT

A gas turbine engine includes a turbine section that has a disk rotatable about an axis. The disk has circumferentially-spaced blade mounting features and radially outer rim surfaces extending circumferentially between the blade mounting features. Turbine blades are mounted circumferentially around the disk in the blade mounting features. Seals are arranged radially outwards of the disk adjacent the radially outer rim surfaces such that there are respective passages between the seals and the radially outer rim surfaces. The radially outer rim surfaces include radially-extending protrusions that extend into the respective passages.

16 Claims, 3 Drawing Sheets

(51) Int. Cl.

| | |
|---|---|
| ***F01D 5/08*** | (2006.01) |
| ***F01D 5/30*** | (2006.01) |
| ***F01D 11/02*** | (2006.01) |
| ***F01D 25/12*** | (2006.01) |

(52) U.S. Cl.

CPC ..... *F01D 11/003* (2013.01); *F01D 11/005* (2013.01); *F01D 11/008* (2013.01); *F01D 11/02* (2013.01); *F01D 25/12* (2013.01); *F05D 2240/127* (2013.01); *F05D 2240/55* (2013.01); *F05D 2260/20* (2013.01); *F05D 2260/2212* (2013.01)

(56) References Cited

U.S. PATENT DOCUMENTS

| | | | | |
|---|---|---|---|---|
| 4,519,885 | A | 5/1985 | Innis | |
| 4,659,285 | A | 4/1987 | Kalogeros et al. | |
| 4,775,296 | A | 10/1988 | Schwarzmann et al. | |
| 5,252,026 | A * | 10/1993 | Shepherd | F01D 5/081 415/115 |
| 5,513,955 | A * | 5/1996 | Barcza | F01D 5/22 416/193 A |
| 5,573,375 | A | 11/1996 | Barcza | |
| 5,797,726 | A | 8/1998 | Lee | |
| 5,888,049 | A | 3/1999 | Broadhead et al. | |
| 5,975,844 | A | 11/1999 | Milazar et al. | |
| 5,984,630 | A | 11/1999 | Di Salle et al. | |
| 6,565,322 | B1 * | 5/2003 | Lieser | F01D 11/006 416/190 |
| 6,749,400 | B2 | 6/2004 | Dougherty et al. | |
| 7,901,186 | B2 | 3/2011 | Cornett et al. | |
| 2005/0025622 | A1 | 2/2005 | Djeridane et al. | |
| 2007/0297917 | A1 | 12/2007 | Levine et al. | |
| 2008/0267784 | A1 | 10/2008 | Bolms et al. | |
| 2012/0282109 | A1 | 11/2012 | Stiehler | |

OTHER PUBLICATIONS

European Search Report for European Patent Application No. 14843390 completed Oct. 4, 2016.

International Search Report and Written Opinion for PCT Application No. PCT/US2014/051979 completed Mar. 27, 2015.

* cited by examiner

GAS TURBINE ENGINE WITH DISK HAVING PERIPHERY WITH PROTRUSIONS

CROSS-REFERENCE TO RELATED APPLICATION

This application claims priority to U.S. Provisional Application No. 61/878,096, filed Sep. 16, 2013.

STATEMENT REGARDING GOVERNMENT SUPPORT

This invention was made with government support under contract number FA8650-09-D-2923-0021 awarded by the United States Air Force. The government has certain rights in this invention.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

A speed reduction device, such as an epicyclical gear assembly, may be utilized to drive the fan section such that the fan section may rotate at a speed different than the turbine section. In such engine architectures, a shaft driven by one of the turbine sections provides an input to the epicyclical gear assembly that drives the fan section at a reduced speed.

SUMMARY

A gas turbine engine according to an example of the present disclosure includes a turbine section. The turbine section includes a disk rotatable about an axis. The disk has a plurality of circumferentially-spaced blade mounting features and radially outer rim surfaces that extend circumferentially between the blade mounting features. A plurality of turbine blades is mounted circumferentially around the disk in the blade mounting features. A plurality of seals is arranged radially outwards of the disk adjacent the radially outer rim surfaces such that there are respective passages between the plurality of seals and the radially outer rim surfaces. The radially outer rim surfaces include a plurality of radially-extending protrusions extending into the respective passages.

In a further embodiment of any of the foregoing embodiments, the protrusions are elongated ridges.

In a further embodiment of any of the foregoing embodiments, the elongated ridges extend in an elongation direction that is obliquely angled to the axis.

In a further embodiment of any of the foregoing embodiments, the protrusions are chevron-shaped.

In a further embodiment of any of the foregoing embodiments, the protrusions have a uniform height.

In a further embodiment of any of the foregoing embodiments, the protrusions have a uniform height, H, and a pitch spacing, S, and a ratio of S/H is from 5 and 25.

In a further embodiment of any of the foregoing embodiments, the protrusions have a height, H, and a channel height, CH, between a base surface of the radially outer rim surfaces and the plurality of seals, and a ratio of H/CH is from 0.2 to 0.4.

In a further embodiment of any of the foregoing embodiments, further comprising a plurality of platform seals arranged radially outwards of the plurality of seals.

A disk for a gas turbine engine according to an example of the present disclosure includes a disk body configured to be arranged in a turbine section of a gas turbine engine. The disk body includes a plurality of circumferentially-spaced blade mounting features and radially outer rim surfaces extending circumferentially between the blade mounting features. Each of the radially outer rim surfaces includes a plurality of radially-extending protrusions.

In a further embodiment of any of the foregoing embodiments, the protrusions are elongated ridges.

In a further embodiment of any of the foregoing embodiments, the elongated ridges extend in an elongation direction that is obliquely angled to the axis.

In a further embodiment of any of the foregoing embodiments, the protrusions are chevron-shaped.

In a further embodiment of any of the foregoing embodiments, the protrusions have a uniform height.

In a further embodiment of any of the foregoing embodiments, the protrusions have a uniform height, H, and a pitch spacing, S, and a ratio of S/H is from 5 and 25.

A method for facilitating thermal transfer in a gas turbine engine according to an example of the present disclosure includes turbulating a cooling fluid using the plurality of radially-extending protrusions of any of the foregoing embodiments.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
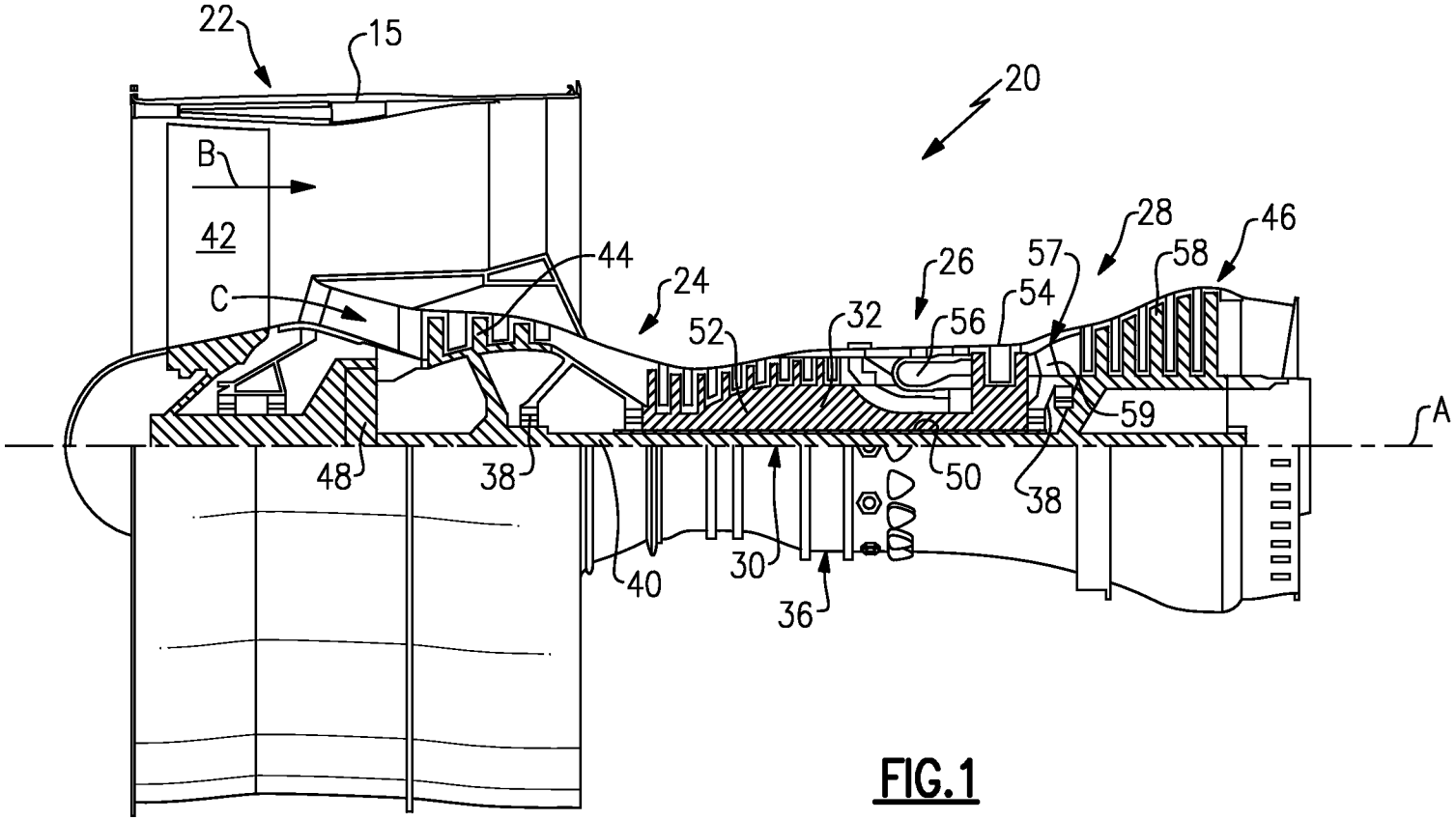
FIG. 1 illustrates an example gas turbine engine.

FIG. 1 schematically illustrates a gas turbine engine 20. The gas turbine engine 20 is disclosed herein as a two-spool turbofan that incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it is to be understood that the concepts described herein are not limited to use with two-spool turbofans and the teachings can be applied to other types of turbine engines, including three-spool architectures and ground-based turbines.

The engine 20 includes a low speed spool 30 and a high speed spool 32 mounted for rotation about an engine central axis A relative to an engine static structure 36 via several bearing systems, shown at 38. It is to be understood that various bearing systems at various locations may alternatively or additionally be provided, and the location of bearing systems may be varied as appropriate to the application.

The low speed spool 30 includes an inner shaft 40 that interconnects a fan 42, a low pressure compressor 44 and a low pressure turbine 46. The inner shaft 40 is connected to the fan 42 through a speed change mechanism, which in this example is a gear system 48, to drive the fan 42 at a lower speed than the low speed spool 30. The high speed spool 32 includes an outer shaft 50 that interconnects a high pressure compressor 52 and high pressure turbine 54.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A combustor 56 is arranged between the high pressure compressor 52 and the high pressure turbine 54. A mid-turbine frame 57 of the engine static structure 36 is arranged between the high pressure turbine 54 and the low pressure turbine 46. The mid-turbine frame 57 further supports bearing system 38 in the turbine section 28. The inner shaft 40 and the outer shaft 50 are concentric and rotate via, for example, bearing systems 38 about the engine central axis A which is collinear with their longitudinal axes.

Core airflow in the core air flow path C is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and gear system 48 can be varied. For example, gear system 48 may be located aft of combustor section 26 or even aft of turbine section 28, and fan section 22 may be positioned forward or aft of the location of gear system 48.

The engine 20 in one example is a high-bypass geared engine. In a further example, the engine 20 has a bypass ratio that is greater than about six (6), with an example embodiment being greater than about ten (10), the gear system 48 is an epicyclic gear train, such as a planet or star gear system, with a gear reduction ratio of greater than about 2.3, and the low pressure turbine 46 has a pressure ratio that is greater than about five (5). In one disclosed embodiment, the bypass ratio is greater than about ten (10:1), the fan diameter is significantly larger than that of the low pressure compressor 44, and the low pressure turbine 46 has a pressure ratio that is greater than about five (5). It is to be understood, however, that the above parameters are only exemplary and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

The fan 42, in one non-limiting embodiment, includes less than about twenty-six fan blades. In another non-limiting embodiment, the fan section 22 includes less than about twenty fan blades. Moreover, in a further example, the low pressure turbine 46 includes no more than about six turbine rotors. In another non-limiting example, the low pressure turbine 46 includes about three turbine rotors. A ratio between the number of fan blades and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Figure 2:
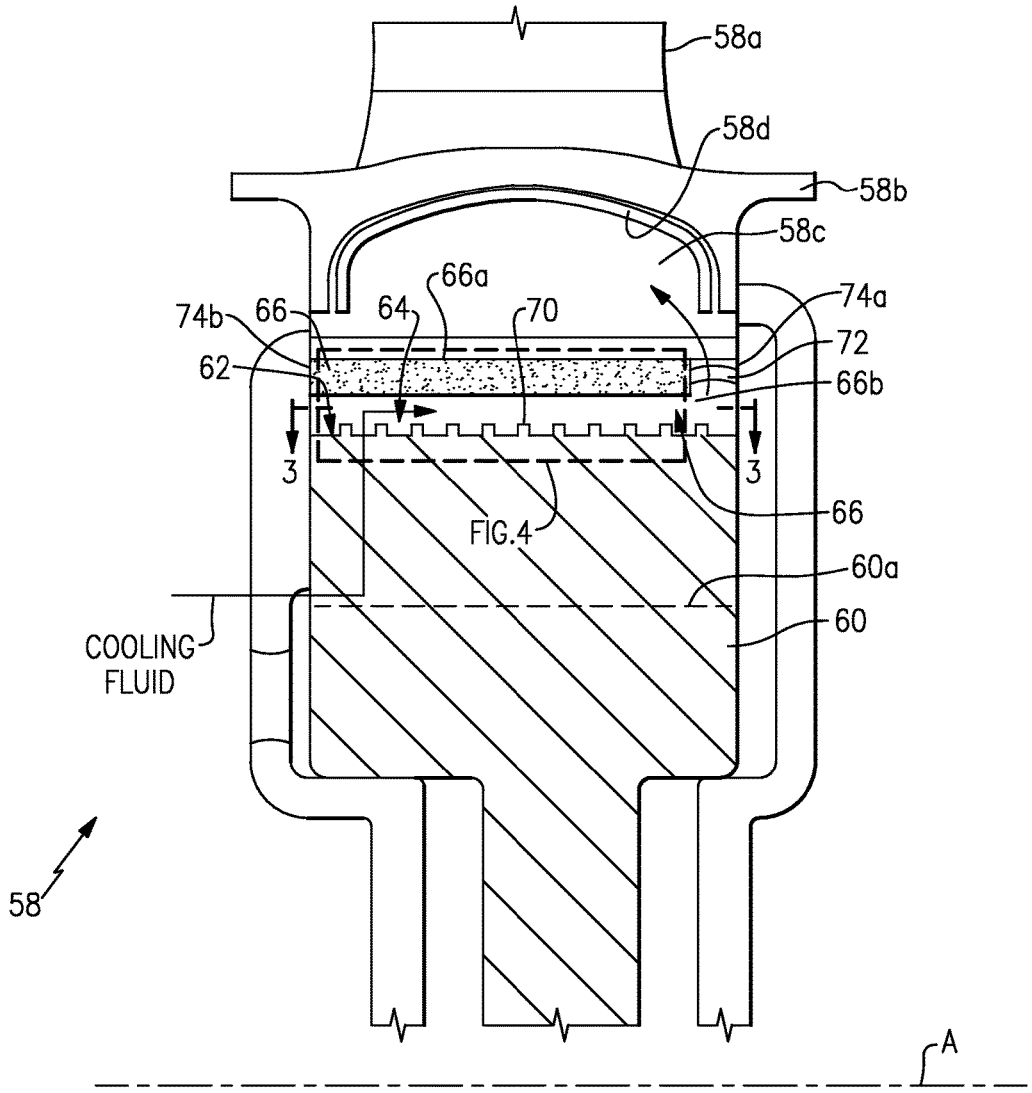
FIG. 2 illustrates an example turbine blade of the gas turbine engine of FIG. 1.

FIG. 2 shows portions of a representative turbine blade 58 in the turbine section 28. In this example, the turbine blade 58 includes an airfoil section 58*a*, an enlarged platform 58*b* and a root 58*c* that serves to mount the blade 58 on a disk 60. The disk 60 is rotatable about the central axis A of the engine 20, and a plurality of the turbine blades 58 are mounted in a circumferentially-spaced arrangement around a periphery 62 of the disk 60. In this regard, referring also to the view of the disk 60 shown in FIG. 3, the disk 60 has circumferentially-spaced mounting features, represented at 60*a*, such as slots, for mounting the respective turbine blades 58 thereon. Such mounting features 60*a* or slots are known and therefore not described in further detail herein. Radially outer rim surfaces 64 extend circumferentially between the blade mounting features 60*a*.

As can be appreciated, a substantial portion of the blade 58, including the airfoil section 58*a* and outer surface of the platform 58*b*, is exposed to high temperature gases in the core flow path C of the engine 20. In this regard, a plurality of platform seals 58*d* can be provided between adjacent neighboring blades 58 to limit passage of high temperature gases. However, some high temperature gas can leak past such that at least the radially outer rim surfaces 64 of the disk 60 can be exposed to the high temperature gases. In order to protect the disk 60 from the high temperatures, a plurality of seals 66 are arranged between the turbine blades 58 and the periphery 62 of the disk 60. The seals 66 are located radially inwards of the platform seals 58*d* (i.e., the platform seals 58*d* are radially outwards of the seals 66). Cooling fluid can be provided into a passage 68 that is bounded on a radially outer side by the seal 66 and on a radially inner side by the radially outer rim surfaces 64 of the disk 60. In one example, the cooling fluid is provided from the compressor section 24 of the engine 20, although other sources of cooling fluid could also be used.

Each of the seals 66 includes a radially outer surface 66*a* and a radially inner surface 66*b*. The radially inner surface 66*b* is oriented toward the periphery 62 of the disk 60. Thus, the cooling fluid is bounded on one side by the radially inner surface 66*b* of the seal 66.

The radially outer rim surfaces 64 of the disk 60 each include a plurality of protrusions 70 that extend into the respective passages 68. The protrusions 70 function to turbulate, or mix, the flow of the cooling fluid as it travels through the passage 68. The turbulent flow facilitates heat transfer from the periphery 62 of the disk 60 to maintain the disk 60 at a desired temperature.

Optionally, the seal 66 can include a through-hole 72 to allow the cooling fluid to escape past the seal 66 and vent to the core gas path C. In this example, the through-hole 72 is located near an aft edge 74*a* of the seal 66. In other examples, depending upon the inlet location of the cooling fluid into the passage 68, the through-hole 72 can be relocated near a forward edge 74*b* of the seal 66, or other location in between the forward and aft edges 74*a*/74*b*.

Figure 3:
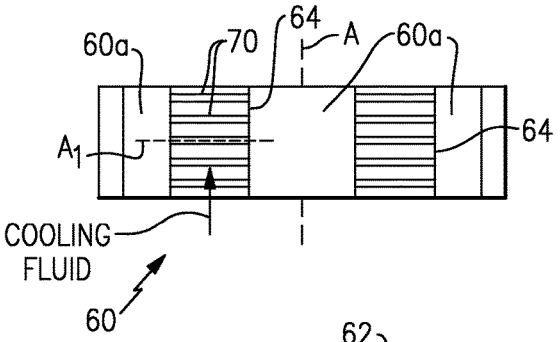
FIG. 3 illustrates a radial view of a disk of FIG. 2.
Figure 4:
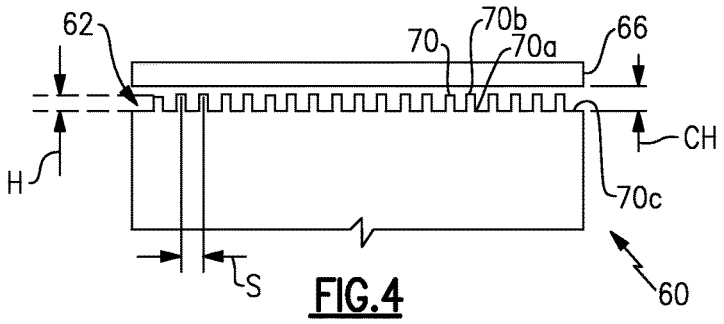
FIG. 4 illustrates a sectioned view of a disk of FIG. 2.

FIGS. 3 and 4 show sectioned views of the radially outer rim surface 64 according to the section lines shown in FIG. 2. Referring to FIG. 4, the protrusions 70 in this example have a uniform height, H, between their respective protrusion bases 70*a* and free ends 70*b*. The protrusions 70 also define a pitch spacing, S, there between, and a channel height, CH, between base surface 70*c* and the seal 66. The height and pitch spacing can be adjusted to provide a desired level of turbulence or mixing of the cooling fluid. Similarly, the height and channel height can be adjusted to provide a desired level of turbulence or mixing of the cooling fluid. In one example, the height is 0.003-0.030 inches (76.2-762 micrometers). In another example, the height and pitch spacing are controlled with respect to one another such that there is a correlation represented by a ratio S/H (S divided by H) that is from 5 to 25. In a further example, the height and channel height are controlled with respect to one another such that there is a correlation represented by a ratio H/CH (H divided by CH) that is from 0.2 to 0.4. The example ratio ranges can provide a desirable level of mixing for the expected velocity of the cooling fluid flowing through the passage 68.

As can be appreciated, the shape and orientation of the protrusions 70 can be varied to achieve a desired turbulation effect on the flow of cooling fluid. For example, the protrusions 70 can include geometric patterns of ridges, pedestals or combinations thereof. The pedestals can have a cylindrical shape or rectilinear shape, for example.

As shown in FIG. 3, the protrusions 70 are elongated ridges that extend along elongation directions, $A_1$. The elongation directions $A_1$ in this example are substantially perpendicular to the central engine axis, A. In other examples, the elongation directions, $A_1$, are obliquely angled with respect to the engine central axis A.

Figure 5:
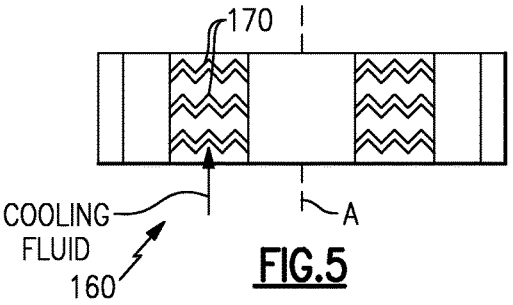
FIG. 5 illustrates a radial view of another example disk.
Figure 6:
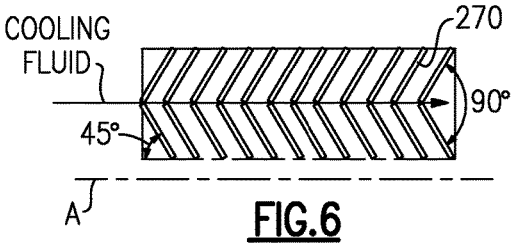
FIG. 6 illustrates a view of another example protrusion pattern having a chevron shape.
Figure 7:
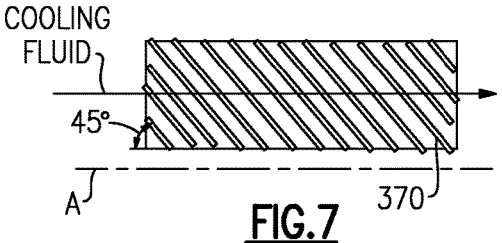
FIG. 7 illustrates a view of another example protrusion pattern having parallel protrusions that are uniformly angled.

FIG. 5 shows another example disk 160 having protrusions 170. In this example, the protrusions 170 are also elongated ridges, but instead of having linear in shape, the protrusions 170 have a chevron-shape. As can be appreciated, the angle of the chevrons, the height, the pitch spacing, and other geometric aspects of the protrusions 170 can be varied to provide a desirable turbulation effect. A further example is depicted in FIG. 6, which, for the purpose of description only shows the protrusion pattern. In this example, protrusions 270 also have a chevron-shape. The legs of the chevrons are angled approximately 45° to the engine central axis A and approximately 90° to each other. Another example is depicted in FIG. 7, in which protrusions 370 are parallel but uniformly angled at approximately 45° to the engine central axis A.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A gas turbine engine comprising:

a turbine section including:

a disk rotatable about an axis and including a plurality of circumferentially-spaced blade mounting features and radially outer rim surfaces extending circumferentially between the blade mounting features, a plurality of turbine blades mounted circumferentially around the disk in the blade mounting features, a plurality of seals arranged radially outwards of the disk adjacent the radially outer rim surfaces such that there are respective passages between the plurality of seals and the radially outer rim surfaces, and the radially outer rim surfaces including a plurality of radially-extending protrusions extending into the respective passages, wherein the protrusions are elongated ridges, and where the elongated ridges extend in an elongation direction that is obliquely angled to the axis.

2. The gas turbine engine as recited claim 1, wherein the protrusions are chevron-shaped.

3. The gas turbine engine as recited in claim 1, wherein the protrusions have a uniform height.

4. The gas turbine engine as recited in claim 1, wherein the protrusions have a uniform height, H, and a pitch spacing, S, and a ratio of S/H is from 5 and 25.

5. The gas turbine engine as recited in claim 1, wherein the protrusions have a height, H, and a channel height, CH, between a base surface of the radially outer rim surfaces and the plurality of seals, and a ratio of H/CH is from 0.2 to 0.4.

6. The gas turbine engine as recited in claim 1, further comprising a plurality of platform seals arranged radially outwards of the plurality of seals.

7. A disk for a gas turbine engine, the disk comprising:

a disk body configured to be arranged in a turbine section of the gas turbine engine, the disk body including a plurality of circumferentially-spaced blade mounting features and radially outer rim surfaces extending circumferentially between the blade mounting features, each of the radially outer rim surfaces including a plurality of radially-extending protrusions, wherein the protrusions are elongated ridges, and wherein the elongated ridges extend in an elongation direction that is obliquely angled to the axis.

8. The disk as recited claim 7, wherein the protrusions are chevron-shaped.

9. The disk as recited in claim 7, wherein the protrusions have a uniform height.

10. The disk as recited in claim 7, wherein the protrusions have a uniform height, H, and a pitch spacing, S, and a ratio of S/H is from 5 and 25.

11. A method for facilitating thermal transfer in a gas turbine engine, the method comprising:

providing a turbine section that includes:

a disk rotatable about an axis and including a plurality of circumferentially-spaced blade mounting features and radially outer rim surfaces extending circumferentially between the blade mounting features, a plurality of turbine blades mounted circumferentially around the disk in the blade mounting features, a plurality of seals arranged radially outwards of the disk adjacent the radially outer rim surfaces such that there are respective passages between the plurality of seals and the radially outer rim surfaces, and the radially outer rim surfaces including a plurality of radially-extending protrusions extending into the respective passages providing a cooling fluid through the passages; and turbulating the cooling fluid using the plurality of radially-extending protrusions, wherein the protrusions are elongated ridges, and where the elongated ridges extend in an elongation direction that is obliquely angled to the axis.

12. A gas turbine engine comprising:

a turbine section including:

a disk rotatable about an axis and including a plurality of circumferentially-spaced blade mounting features and radially outer rim surfaces extending circumferentially between the blade mounting features, a plurality of turbine blades mounted circumferentially around the disk in the blade mounting features, a plurality of seals arranged radially outwards of the disk adjacent the radially outer rim surfaces such that there are respective passages between the plurality of seals and the radially outer rim surfaces, and the radially outer rim surfaces including a plurality of radially-extending protrusions extending into the respective passages, wherein the protrusions have a height, H, and a channel height, CH, between a base surface of the radially outer rim surfaces and the plurality of seals, and a ratio of H/CH is from 0.2 to 0.4.

13. The gas turbine engine as recited in claim 12, wherein the protrusions are elongated ridges, and where the elongated ridges extend in an elongation direction that is obliquely angled to the axis.

14. The gas turbine engine as recited in claim 12, wherein the protrusions are chevron-shaped.

15. The gas turbine engine as recited in claim 12, wherein the protrusions have a uniform height.

16. The gas turbine engine as recited in claim 12, wherein the protrusions have a uniform height, H, and a pitch spacing, S, and a ratio of S/H is from 5 and 25.

* * * * *